US005605230A

United States Patent [19]

Marino, Jr. et al.

[11] Patent Number: 5,605,230

[45] Date of Patent: Feb. 25, 1997

[54] SEALED LABEL HAVING ANTI-COUNTERFEIT CONSTRUCTION

[75] Inventors: Michael A. Marino, Jr., Marlton; John L. Gordon, Jr., Yardville; Richard J. St. Hilaire, Cherry Hill, all of N.J.

[73] Assignee: ELR, Inc., Wilmington, Del.

[21] Appl. No.: 320,720

[22] Filed: Oct. 11, 1994

[51] Int. Cl.[6] ..... B65D 5/43

[52] U.S. Cl. ..... 206/534; 206/497; 206/807; 215/901; 40/5; 40/310

[58] Field of Search ..... 206/534, 459.5, 206/497, 807; 215/901; 40/5, 310, 446; 283/81, 74

[56] References Cited

U.S. PATENT DOCUMENTS 4,546,881 10/1985 Tasma ..... 206/807 X 5,495,944 3/1996 Lermer ..... 206/807 X

*Primary Examiner*—Jacob K. Ackun

*Attorney, Agent, or Firm*—Seidel, Gonda, Lavorgna & Monaco, P.C.

[57] ABSTRACT

A container, such as the type having a base portion, and an upper neck portion, a shoulder portion between the neck and base portion and a removable closure applied to the neck portion in a sealed relation therewith, is provided with an anti-counterfeit multi-layer label construction. The multi-layer construction includes a label which is adhesively applied to the back side of a container. A printed indicia is provided on the front side of the label so as to be readable by the customer upon removal of an overlying sleeve which is placed over the label. The sleeve is in the form of a protective film which is heat shrunk into a conforming, sealed relationship around the container and which covers at least a portion of the label. A release coat is provided over the underlying printing. A background coat is provided over the release coat so as to cover the underlying printing. Top indicia is provided on the background coat with a varnish thereon. An adhesive is applied on the inside of the sleeve and is brought into contact and sealed with the coatings on the label upon shrinking the sleeve onto the container. Upon removal of the sleeve, the top indicia and the background coatings are removed. The release coat serves as a removable base for the overlying printing. Upon removal of the sleeve, only the underlying printing on the label is exposed.

33 Claims, 1 Drawing Sheet

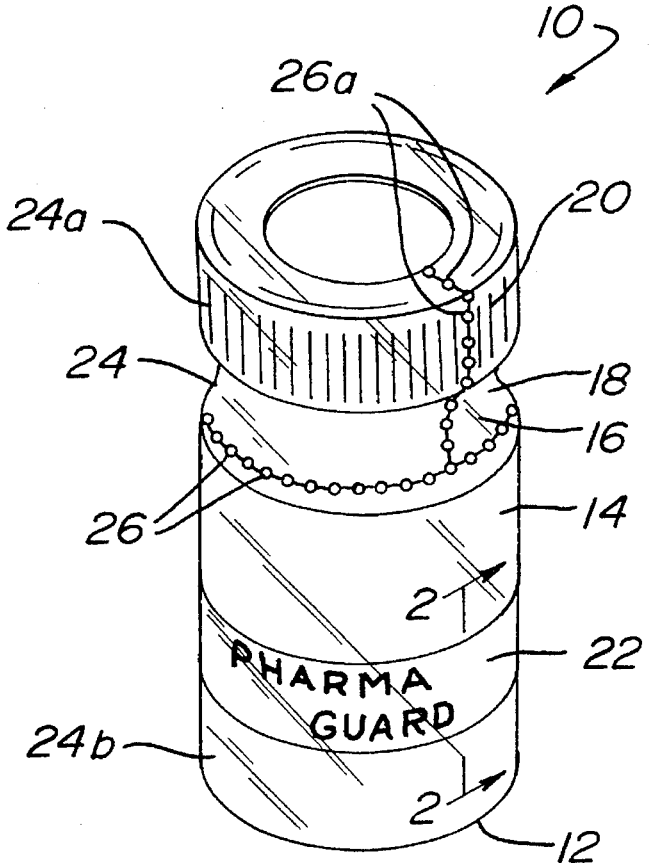
FIG. 1
FIG. 2
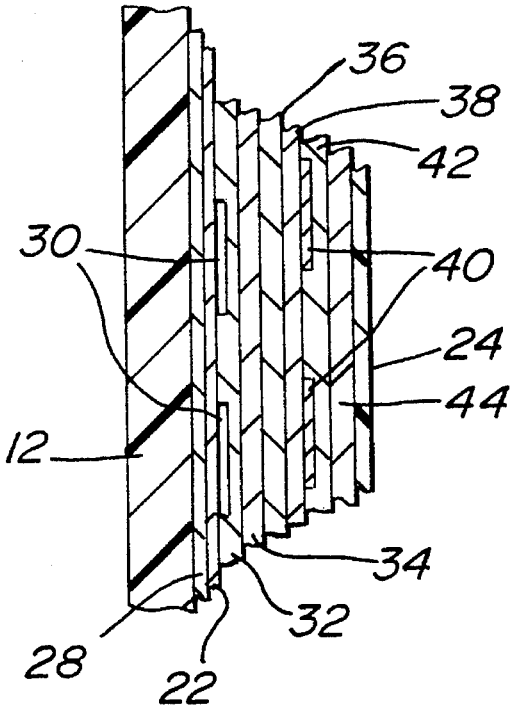

SEALED LABEL HAVING ANTI-COUNTERFEIT CONSTRUCTION

BACKGROUND OF THE INVENTION

The present invention relates to providing a container, such as a prescription pharmaceutical bottle or the like, with a label construction which permits the determination of whether or not the label is counterfeit. The present invention may also be directed to providing a tamper indication on a container or the like.

BACKGROUND OF THE INVENTION

For some time, there has been a need to seal packages and containers at the factory in a manner that illustrates to the ultimate purchaser that the material retained therein has not been tampered with prior to its purchase.

Another problem that has become evident to the pharmaceutical industry is the sale of illegitimate or counterfeit pharmaceuticals. This potential problem increases with pharmaceuticals that are sold in high quantities and/or are expensive to manufacture and reproduce. Oftentimes, the ultimate distributor of the products may not be aware of the illegitimate nature of the products. Unscrupulous distributors have been known to duplicate containers and their labels using normal printing processes, inserting expired medication, unlicensed products or placebos therein.

In order to combat these problems, it is proposed to provide a composite label that indicates its authenticity and that cannot be easily duplicated.

BRIEF SUMMARY OF THE INVENTION

The present invention relates to a container, such as a pharmaceutical container, having a label thereon. The construction of the label may be varied such that the indicia and/or a portion of the label is removed in desired patterns to indicate authenticity.

The container contemplated for use with the present invention may take many forms. One possible container includes a base portion, an upper neck portion, a shoulder portion formed between the base and the neck portion, and a removable closure means applied to the neck portion in a sealed relation therewith. The label is provided on the outside of the container, such as on the base portion, by means of an adhesive. Printing is applied on the front side of the label. The printing is contemplated to include multiple layers or coatings which are at least partially removable, dependent upon the relationship of the materials applied. A permanent message may be printed on the label with the various coatings applied thereover. Over the coatings is printed the consumer information, such as the trademark, descriptive material and identification of goods.

A protective film sleeve may be provided over the label and/or the container. The film may be in the form of a sleeve which is heat shrunk into a conforming, sealed relation around the container, covering at least a portion of the top printing on the label. Separate printing may also be provided on the sleeve itself. A possible variation of the container and sleeve combination would include the use of a heat activated adhesive between the front side of the label and the sleeve. The adhesive forms a bond between the top printing (and a portion of the coatings) and the sleeve, such that removal of the sleeve also removes (at least) the top printing from the front side of the label. Removal of the top printing exposes a permanent message applied on the base of the printed layers.

BRIEF DESCRIPTION OF THE DRAWINGS

For the purpose of illustrating the invention, there is shown in the drawings various forms which are presently preferred; it being understood, however, that the invention is not limited to the precise arrangements and instrumentalities shown.

FIG. 1 shows an embodiment of a container incorporating an anti-counterfeit label construction as contemplated by the present invention.

FIG. 2 shows a cross-sectional view of the layered construction of the label of the present invention.

DETAILED DESCRIPTION OF THE DRAWINGS

In the drawings there is shown an embodiment of the present invention. Within the drawings, like elements are identified by similar numerals. In FIG. 1, there is shown a container having a label attached thereto which in combination is generally identified by the numeral 10. As shown, the container comprises a bottle 12 of the type having a cylindrical base portion 14, an upper shoulder portion 16, a tapered neck portion 18, and a cap or other removable closure means 20. The cap 20 may be removably connected to the neck portion 18 of the bottle 12 in any manner desired, such as using a press-fit, screw threads, or other closure means. The cap 20 may include a child resistant opening. The container may also take the form of a box or may have any shape desired.

On the outside surface of the bottle is provided a label 22. As illustrated, a protective film sleeve 24 of the type that is to be heat shrunk onto the container is provided over the top of the label 22, bottle 12 and cap 20. The sleeve 24 is formed as a cylindrical tube which is placed over the bottle 12, covering the neck 18, shoulder 16 and base 14. The sleeve is brought into a tight conforming, sealed relationship with the bottle 12 by the application of heat. The sleeve 24 is contemplated to cover at least a portion of the label 22.

The sleeve 24 includes a series of perforations 26. The perforations 26 are provided to separate the upper portion **24*a* of the sleeve 24, which covers cap 20, from the container 12. A horizontal ring of perforations 26 is provided adjacent the shoulder 16 when the sleeve 24 is heat shrunk onto the bottle 12. Also included is a vertical line of perforations 26*a* for separation of the removed upper portion 24*a* of the sleeve 24 from the cap 20. Upon removal of the upper portion 24*a* of sleeve 24, the lower sleeve portion 26*a* remains on the base 14, covering the label 22. Removal of the upper portion 24*a* also exposes the cap so that it may be removed for access to the inside of the bottle 12**.

FIG. 2 shows a cross-sectional view of a combination of layers that create the structure illustrated in FIG. 1. Starting from the bottom, there is illustrated in cross-section the wall of the bottle 12. The bottom surface of the label 22 is attached to the outside surface of the bottle 12 by means of an adhesive 28. On the top surface of the label 22 is provided printed indicia 30. This printed indicia 30 is intended to provide a permanent indication of the validity of the bottle and/or an indication that the sleeve 24 has been removed from the label at some point in time. This printed indicia may take the form of a "cancel" statement, lot code number, or the like, which will be revealed upon removal of the upper layers (discussed below).

On top of label 22 and printed indicia 30 is provided a release coat 32. The release coat 32 is used to cover printing 30 such that the indicia would not be removed from the label 22 upon removal of the layers above it on the label.

On top of the release coat 32 is provided a scratch-off extender coating 34. This extender coating 34 is preferably made of a material that is normally used to lighten the color of inks or as a base for a scratch-off or removable type ink. On top of the extender 34 is provided a background coating 36 which is preferably a scratch-off type ink. This background coating 36 may be any color desired but is preferably different from the color of the underlying label 22.

On top of background coating 36 is provided a second background coating 38. This second coating 38 forms a base for printed indicia 40. It is noted that a number of colors may be printed on top of the coating 38 depending on the desired graphics for the label. On top of printing 40 is provided a varnish layer 42. The varnish 42 seals the printed label structure to stabilize the coatings and printing.

It is contemplated that a single coating of material may be provided over the release coat 32. This single coating may be used to replace the extender coating 34 and the background coating 36 and 38.

The preferred materials contemplated for the label structure described above include a paper label 22 which may be of any material desired. One possible material may be a C1S (i.e., coating one side) semi-gloss coated pharmaceutical litho paper. Preferably, a 32 pound basis weight is utilized. Such materials are available from Zimmer Paper Products, Inc. of Indianapolis, Ind. Typically, all litho papers are coated. A clay coating on the paper material provides for a smooth print surface and closes the pores of the paper. An uncoated type paper is desired for the printing surface of label 22 so as to retain the underlying indicia 30 on the label, upon removal of the coatings.

The adhesive 28 provided on the underside of the label is contemplated to be a hot melt rubber adhesive (Kraton® based polymer). This type adhesive, although applied preferably with heat, is still considered to be a pressure-sensitive type adhesive. The paper label 22 and adhesive 28 may be purchased in combination with a liner (not shown) and supplied in rolls. In this manner, the label 22 may be printed (and retained in rolls) prior to its application to the bottle 12. The printed label 22 is applied to the bottle 12 using known machinery. The liner (again, not shown) is preferably a 40 pound bleached white kraft paper having a silicone coating thereon, although any type liner may be used as desired. The adhesive 28 as described above is generally designated by Zimmer as A113.

The printing of indicia 30 onto the top surface of the label 22 is preferably performed by a flexographic printing machine using a water based ink. Such water based inks may be obtained from Environmental Inks and Coatings Corporation of Baltimore, Md. The flexo printing method is preferred due to the die cut capabilities on the equipment available at the time of the creation of the invention. Other printing methods may be used and are contemplated. A water based ink is chosen since the fluid will wick into the paper stock. This wicking action is enhanced by the lack of clay coating on the top surface of the paper preferably used for the base of label 22. Also, by using water based inks, a drying action will be created by absorption into the surface and by evaporation, without the use of forced air drying equipment.

As an alternative, UV curable inks may be used and applied by a flexographic, gravure or screen printing process. UV curable inks may sit up on the paper sock, however, and may separate from the paper stock. The effect may cause the ink to split upon removal of the upper coatings, thus removing part or all of the underlying indicia from the label 22.

Release coat 32 is preferably a Spiroto™ type coating which is laid down with a 300 lines per inch laser engraved anilox roller. Spiroto is believed to be a trademark of a Gotham Ink and Color Company, Inc. Gotham is based in New York City and provides a number of release coat systems and combinations.

Extender coating 34 is a clear coating which is applied over top of the release coat 32 and the underlying printing 30. Coating 34 acts as a bottom sealer for the layers that are to be removed. The release coat 32 serves to separate the scratch off extender 34 from printing 30. Again, it is contemplated that the extender 34 be applied with a 300 lines per inch laser engraved anilox roller to give sufficient coating thickness. The scratch off extender 34 is also available from Gotham.

The background coating 36 is preferably a "scratch off" type ink. Numerous sources for such inks are available to those in the art. The combination of the extender coating 34 with the scratch off type ink for background coating 36 will further cause separation of the top layers from the underlying indicia 30. Thus, the extender coat 34 further serves as a release for the top printing along with release coat 32.

The second background coating 38 is used to create an opaque printing surface. This background coating 38 is contemplated to be the same material as that used for the first coating 36. It is noted, however, that variations of this structure may be made, such as by using different colors, with or without a release layer therebetween. The removal of the upper coating 38, thus, may expose the color of the lower coating 36.

Top indicia 40 forms the top of the label. This printed information may also be applied as a water based ink, similar to that used for the underlying indicia 30. Over the top printing 40 is provided a varnish 42 which is preferably UV curable. Such varnishes are available from Sun Chemical Corporation of Philadelphia, Pa. and are designated as RC 88–1147. The varnish 42 may be laid down with a 200 laser anilox roller to provide sufficient coating thickness. The water based ink is contemplated to be laid downed using a 550 laser anilox roller.

It is also contemplated that a second release coat may be provided between underlying printing 30 and the extender coat 34. This second release coat will create a more complete coverage and insure that the underlying label structure is not removed.

The label construction is contemplated to be capable of withstanding a normal rub test, so that it will not scratch off during normal use. This result is contemplated to occur even without the use of a protective film. Thus, the label as contemplated by the present invention may comprise the combination of the underlying base layer 22, underlying printing 30, and the overlying, removable coatings (such as coatings 34 through 42). In this form, the overlying coatings can be removed by applying an adhesive tape to the printing and lifting the printing from the surface of the label base layer. Also, the film sleeve 24 may be applied to the container 10 without the use of the sleeve adhesive which secures the film to the coatings. In this manner the film 24 acts to protect the overlying coatings (such as layers 34 through 42). However, removal of the film will not result in removal of these coatings. Furthermore, the protective film may be applied over the coatings, without the requirement of the film being heat shrinkable.

In the embodiment of the invention where the sleeve 24 is desired to adhere to the upper coatings, an adhesive 44 is provided on the inside of the film. This adhesive, preferably printed onto the sleeve 24 during its fabrication, 10 is used to secure the sleeve 24 to the label 22. The adhesive for the label 22 should, however, have a bond which is as strong or stronger than the bond of the sleeve adhesive 44 to the label 22. This will cause the label 22 to remain bonded to the container upon removal of the sleeve.

A preferred adhesive for the sleeve 44 is available from Morton-Thiokol Incorporated, of Chicago, Ill. and is designated as 37 P295. This material is a standard formulation for a heat shrink sleeve adhesive, and is typically used to prevent axial or horizontal movement of the sleeve on straight walled bottles. This material is an emulsion at room temperature and then goes to a glass formation upon curing or heat activation. The adhesive 44 may also be applied over the multiple layers 30 through 42 prior to application of the sleeve.

The shrink sleeve, preferably made of PVC material approximately 50 microns thick, is wrapped around the bottle 12 and then heat shrunk into contact with the outside surfaces thereof. The adhesive 44 is attached to the printed layers 34 through 42 when the heat shrink sleeve is brought into contact with the bottle 12 and the label 22. The adhesive 44 is preferably transparent and provided in a heavy lay down. The lay down of adhesive may be created by a chemically etched anilox roller having a surface including approximately 130 lines per inch, at a 60 micron depth and a 10 to 18 wall size. Similar results may be obtained by using an electrical etching process for the anilox roller. One contemplated construction would include 150 line per inch, 40 to 44 micron depth, and a 12 to 20 wall size. It is also contemplated that the roller may include 120 lines per inch, 100 depth and 10 to 18 wall size; 130 lines per inch, 60 depth and 10 to 18 wall size; or 175 lines per inch, 36 to 38 depth and 10 to 12 wall size.

The method of assembly of the container 12 includes the provision of filled and capped bottle 12 with a printed label 22 applied on the outside surface. The label 22 includes the printing and coatings, such as layers 30 through 42, which have previously been applied to the paper base. The heat shrinkable film sleeve 24 (if desired) is provided over the top of the bottle and then the bottle is passed through a heat tunnel. The heat applied within the tunnel, along with its dwell time, causes the film sleeve 24 to contract and substantially conform to the outer peripheral surface of the bottle 12, including the neck 18 and cap 20. If the sleeve is to be secured to the coatings, the proper temperature and dwell time for applying the sleeve 24 and activating the adhesive 44 must be determined by testing. The critical factor is the activation of the adhesive 44 in conjunction with the shrinking of the sleeve 24. The adhesive 44 must be activated to the extent that it sufficiently bonds with the top varnish 42, with the background coatings 36 and 38 and extender 34 secured thereto. The release coat 32 provides a separation point for removal of the overlying printed coatings and permits exposure of the bottom 30.

Another consideration in heat shrinking the sleeve 24 onto the label 22 and bottle 12 is the size and spacing of the perforations 26. The pattern for the perforations 26 is typically determined by the desires of the customer and the limitations set by the application of the heat to activate adhesive 44. It is has been found that tunnel temperatures in excess of 500° F. for up to 30 seconds of dwell time may be required in order to properly secure the sleeve 24 to the printed layers 34 through 42 by means of adhesive 44. At these activation temperatures, zoned control of the heat in the area of the perforations may be necessary in order to prevent "blow out" of the perforations. Alternatively, lower tunnel temperatures may be used to shrink the sleeve onto the container along with the post tunnel application of steam in the area of the adhesive 44 on the lower portion **24*b* of the sleeve to fully activate the adhesive 44**, while avoiding the perforated portion of the sleeve.

It is possible to eliminate the use of a background coating 36 and/or 38. In this manner, the ink pattern 40 is laid down so as to compliment the underlying printing 30 on the label 22. Thus, removal of the upper printing 40 would expose the underlying printing 30 for the label.

Another variation of the present invention would be to create a color change by the use of the various extender and background color coatings. Multiple layers of inks would be provided in combination so as to create a separate color. Removal of one layer of ink would change the color of the label. For example, a combination of blue and red inks could be supplied for the background coatings 36 and 38. Therebetween, an extender coating and/or a release coat could be provided. These coatings 38 and 40 could also be provided in various patterns, along with release coats, such that the removal of the label would remove a portion of the ink leaving a visible message in a different color. Again, this procedure could be done in conjunction with the underlying message which forms the printing 30 on the top surface of label 22.

Another variation of the invention may include the printing of fluorescent and/or ultraviolet inks which would be readable only upon the application of a UV light or the like. Preferably, these additives would be included on the underlying surfaces, such as part of printing 30. Thus, when the overlying layers are added on top of the label 22, the fluorescent or UV readable inks are not visible even by the application of UV light, without the overlying layers being removed.

Similarly, monofilament fibers may be placed within the underlying label in a specific pattern or location. These monofilament fibers may be included as part of the printing 30 on the underlying label 22. The fibers would not be detectable when viewing the container 10 as pictured in FIG. 1. However, upon removal of the top layer(s), the inspection for the monofilaments could be made.

Another variation of the present invention would be to employ a UV cured, heat activated adhesive as a replacement for the sleeve adhesive 44. It is contemplated that this type adhesive be laid down by the flexographic press on top of varnish 42. An example of such an adhesive is believed to be available from Borden Packaging and Industrial Products of Cincinnati, Ohio and from Craig Adhesives and Coatings Company of Newark, N.J.

The present invention may be embodied in other specific forms without departing from the spirit or essential attributes thereof, and accordingly, reference should be made to the appended claims, rather than to the foregoing specification, as indicating the scope of the invention.

We claim:

1. A container of the type having a base portion, an upper neck portion and a removable closure means applied to the neck portion in a sealed relation therewith, the container including a label thereon, the label comprising:

a label base having a front side and a back side, an adhesive applied to the back side of the label base for adhesively securing the label to the base portion of the container, a protective film sleeve heat shrunk into a conforming, sealed relation around the container and covering at least a portion of the label base, a sleeve adhesive provided between the front side of the label base and the sleeve, the sleeve adhesive forming a bond between the label base and the sleeve such that removal of the portion of the sleeve covering the label removes a portion of the printing on the front side of the label base, and a printed indicia on the label base, the printed indicia including an underlying printed message applied to the front side of the label base, a release coating covering at least a portion of the underlying printing, and an overlying printing applied over the release coating and covering at least a portion of the underlying printing, the sleeve adhesive being secured upon activation to at least the overlying printing and separable from the underlying printing by means of the release coating, whereby removal of the sleeve causes removal of the overlying printing above the release coating and exposing the underlying printing.

2. A label and container as claimed in claim 1, wherein the overlying printing includes a opaque background coating and a top printed indicia thereon, the top printed indicia being visible through the sleeve and sleeve adhesive.

3. A label and container as claimed in claim 2, wherein the overlying printing further comprises an extender coat acting as a support for the background coat.

4. A label and container as claimed in claim 3, wherein the background coat is applied in multiple layers.

5. A label and container as claimed in claim 3, wherein the background coating is in the form of a "scratch off" type ink.

6. A label and container as claimed in claim 5, wherein the multiple background coatings combine to form a specific color combination, and wherein a second release coating is applied between two of the background coatings, such that the overlying background coating is removable along with the sleeve, leaving a printed pattern including a least a portion of the underlying background coating on the label base.

7. A label and container as claimed in claim 6, wherein the underlying printing and the top printing are water based inks.

8. A label and container as claimed in claim 7 further comprising a varnish applied over the top printing.

9. A label and container as claimed in claim 8, wherein the sleeve adhesive is a heat activated emulsion and is applied to the sleeve, the sleeve adhesive being activated as part of the heat shrinking process of the sleeve onto the container.

10. A label and container as claimed in claim 9, wherein the label base is formed from a semi-gloss coated pharmaceutical litho paper having a clay coating only on the back side thereof.

11. A label and container as claimed in claim 1, wherein the underlying printing includes a additive which is visible by the application of UV light and only after removal of the sleeve and the overlying printing.

12. A label and container as claimed in claim 1, wherein the underlying printing includes a monofilament which is arranged in a specific pattern and applied to a specific place on the front side of the label base, whereby the monofilament is identifiable only after removal of the sleeve and the overlying printing.

13. A label and container as claimed in claim 1, wherein the underlying printing is not visible upon final assembly of the container, but which is visible upon removal of the sleeve.

14. A label and container as claimed in claim 1, wherein the sleeve adhesive is a UV curable, heat activated adhesive which is applied between the label base and the sleeve, the adhesive applied to the back side of the label base having a greater bond to the container than the bond between the sleeve and the label base.

15. A label and container as claimed in claim 14, wherein the sleeve adhesive is heat activated and forms a bond with the sleeve during the heat shrinking process for the sleeve.

16. A label for application to a container or the like, the label comprising:

a base layer having a front side and a back side, an adhesive applied to the back side for securing the base layer to the container, a printed indicia on the front side of the base layer, the printed indicia including an underlying printed message applied directly to the front side of the base layer, a release coating covering at least a portion of the underlying printing, and a removable overlying printing covering at least a portion of the underlying printing and the release coating, the overlying printing being separable from the underlying printing by means of the release coating, whereby removal of the overlying printing exposes the underlying printing.

17. A label as claimed in claim 16, wherein the overlying printing includes a opaque background coating and a top printed indicia thereon.

18. A label as claimed in claim 17, wherein the overlying printing further comprises an extender coat acting as a support for the background coat.

19. A label as claimed in claim 17, wherein the background coat is applied in multiple layers.

20. A label as claimed in claim 19, wherein the multiple background coatings combine to form a specific color combination, and wherein a release coating is applied between the coatings, such that the overlying background coat is removable, leaving a printed pattern including a least a portion of the underlying coating on the base layer.

21. A label as claimed in claim 16, wherein the background coating is in the form of a "scratch off" type ink.

22. A label as claimed in claim 16, wherein the underlying printing and the top printing are water based inks.

23. A label as claimed in claim 16 further comprising a varnish applied over the overlying printing.

24. A label as claimed in claim 16, wherein the underlying printing includes an additive which is visible by the application of UV light and only after removal of the sleeve and the overlying printing.

25. A label as claimed in claim 16, wherein the underlying printing includes a monofilament which is arranged in a specific pattern and applied to a specific place on the front side of the base layer, and whereby the monofilament is identifiable only after removal of the overlying printing.

26. A label as claimed in claim 16, further comprising a protective film covering at least a portion of the overlying printing.

27. A label as claimed in claim 26, further comprising a film adhesive provided between the front side of the base layer and the film, the film adhesive forming a bond between the overlying printing and the film such that removal of the portion of the film also removes the bonded overlying printing from the front side of the base layer and exposes the underlying printing.

28. A label as claimed in claim 27, wherein the film adhesive is a UV curable, heat activated adhesive, and wherein the adhesive applied to the back side of the base layer has a greater bonding strength than the bond between the film and the overlying printing.

29. A label as claimed in claim 16, wherein the film adhesive is a heat activated emulsion which is applied to the film prior to the adhesion to the overlying printing, the film adhesive being activatable as part of a heat shrinking of the film.

30. A printed label for a container or the like comprising:

an underlying printing, a release coating covering at least a portion of the underlying printing, and a removable overlying printing covering at least a portion of the underlying printing and the release coating, the overlying printing including an extender coating applied over the top of the release coating, a background coating in the form of a "scratch off" type ink, the background coating blocking view of at least a portion of the underlying priming, a top indicia, the top indicia forming a product identification for the container, the top indicia at least partially positioned over the background coating, and a varnish covering the top indicia and background coating, whereby the overlying printing is separable from the underlying printing by means of the release coating, and whereby the overlying printing covers the underlying printing and prevents viewing thereof until removal of the overlying printing.

31. The label as claimed in claim 30 further comprising a protective film covering the overlying printing.

32. The label as claimed in claim 31 further comprising an adhesive positioned between the protective film and the varnish for securing the overlying printing to the film, such that removal of the overlying film causes removal of the overlying printing.

33. The label as claimed in claim 32 wherein the protective film is a heat shrinkable PVC material and the adhesive is a heat activated, whereby the adhesion between the overlying printing and the protective film is created during the heat shrinking process for the film.

* * * * *